US006681875B2

(12) United States Patent
Larsson et al.

(10) Patent No.: US 6,681,875 B2
(45) Date of Patent: Jan. 27, 2004

(54) GUIDE TUBE OF A DRILL STRING CONFIGURED TO FACILITATE UNSCREWING THEREOF FROM A MEMBER OF THE DRILL STRING

(75) Inventors: Kenneth Larsson, Sandviken (SE); Gösta Reuter, Gävle (SE)

(73) Assignee: Sandvik AB, Sandviken (SE)

( * ) Notice: Subject to any disclaimer, the term of this patent is extended or adjusted under 35 U.S.C. 154(b) by 86 days.

(21) Appl. No.: 09/982,799

(22) Filed: Oct. 22, 2001

(65) Prior Publication Data

US 2002/0050362 A1 May 2, 2002

(30) Foreign Application Priority Data

Oct. 27, 2000 (SE) ..... 0003916

(51) Int. Cl.[7] ..... E21B 17/00

(52) U.S. Cl. ..... 175/320; 175/325.1; 175/405; 175/415; 166/380; 166/242.1; 285/333

(58) Field of Search ..... 175/320, 325.1, 175/325.2, 414–420, 405; 166/380, 242.1; 285/333, 334, 355, 390

(56) References Cited

U.S. PATENT DOCUMENTS 1,320,503 A * 11/1919 Smith ..... 285/119
4,128,135 A 12/1978 Mitchhart et al.
4,416,476 A * 11/1983 Garrett ..... 285/286
4,760,889 A * 8/1988 Dudman ..... 175/320
4,987,961 A * 1/1991 McNeely, Jr. ..... 175/320
5,133,576 A 7/1992 Barnhill
6,145,603 A 11/2000 Weaver et al.
6,202,768 B1 * 3/2001 Lindgren et al. ..... 175/389

* cited by examiner

*Primary Examiner*—David Bagnell
*Assistant Examiner*—Giovanna Collins
(74) *Attorney, Agent, or Firm*—Burns, Doane, Swecker & Mathis, LLP

(57) ABSTRACT

A guide tube for use in a rock drill string includes a main portion, a sleeve disposed at a first end of the main portion, and a male thread portion disposed at a second end of the main portion. The sleeve forms a recess having a female thread. A flush channel extends through the guide tube. The main portion includes a section of reduced cross-section disposed adjacent the sleeve for defining a generally radially extending shoulder between the waist and the sleeve. The shoulder serves to support the guide tube on a rig as percussion is applied to the guide tube for loosening a threaded joint between the guide tube and another member.

12 Claims, 6 Drawing Sheets

GUIDE TUBE OF A DRILL STRING CONFIGURED TO FACILITATE UNSCREWING THEREOF FROM A MEMBER OF THE DRILL STRING

This application claims priority under 35 U.S.C. §§119 and/or 365 to Patent Application Serial No. 003916-4 filed in Sweden on Oct. 27, 2000, the entire content of which is hereby incorporated by reference.

FIELD OF THE INVENTION

The present invention relates to a drill string and a guide tube for mechanical handling in a rock drilling rig.

PRIOR ART

During drilling, especially in open-pit mining, the rock is frequently cracked due to previous explosions, such as is show in FIG. 1. Often the ground is made smooth by a thick layer of cracked rock 6, such that the drilling machine 1 shall be able to travel thereon at the drilling site. It is difficult to drill vertically straight in cracked rock, and therefore different solutions have been suggested to improve the straightness of the hole to be drilled. For instance, a guide tube 2 is provided in direct connection with the drill bit so as to guide the progress of the drill bit and increase the flushing speed outside and above the drill bit. The guide tube is about 4 to 6 meters long and comprises a male thread at its lower end (facing the drill bit) and a female thread 2*a* at its upper end (facing the machine—see FIG. 6). The tube has to be extended when drilling holes which are deeper than the length of the guide tube, preferably by means of rods that have smaller diameters than the tube with the intention to more simply allow passage of the drill dust.

A modern machine for drilling comprises a tong 3 (FIG. 2) for frictionally seizing a tube 2 close to the upper end of the tube 2 during extension and unscrewing. Frequently, the joint is strongly tightened during drilling and therefor the joint must be loosened by use of percussion in order to be unscrewed. During said loosening by use of percussion, which may continue for several minutes, the tube will slide relative to the shoes or clamping means 4 of the tong 3 which are clamping the tube as shown in FIG. 6 and furthermore, heat is developed in the joint. Consequently, the tube end is deformed and martensite is formed in the threads.

OBJECTS OF THE INVENTION

One object of the present invention is to provide a drill string and a guide tube for mechanical handling wherein the above-captioned drawbacks are counteracted.

Another object of the present invention is to provide a drill string and a guide tube for mechanical handling to simplify unscrewing of the thread joint in percussive rock tool equipment.

Still another object of the present invention is to provide a guide tube for mechanical handling which improves the life space of thread joints in percussive rock tool equipment.

SUMMARY OF THE INVENTION

The present invention relates to a guide tube adapted for use in a rock drill string. The guide tube comprises a main portion, a sleeve disposed at a first end of the main portion, and a male thread portion disposed at a second end of the main portion. The sleeve includes a recess having a female screw thread formed therein. A flush channel extends completely through the main portion of the male thread portion and communicates with the recess. The recess has a first length extending along a longitudinal axis of the guide tube. The main portion includes a section of reduced diameter disposed adjacent to first end of the main portion for defining a waist of narrower cross section than a maximum cross section of the sleeve. The waist has a length extending along the axis and is longer than the length of the recess.

The invention also pertains to a drill string for rock drilling, which includes the above-described guide tube.

Another aspect of the invention relates to a method of unscrewing a threaded joint between a member and a guide tube of a drill string. The guide tube comprises a main portion, a sleeve disposed at a first end of the main portion, and a male thread portion disposed at a second end of the main portion. The sleeve channel extends completely through the main portion and the male thread portion and communicates with the recess. The recess has a first length extending along a longitudinal axis of the guide tube. The main portion includes a section of reduced diameter disposed adjacent a first end of the main portion for defining a waist of narrower cross section than a maximum cross section of the sleeve. The waist has a length extending along the axis and is no longer than the length of the recess.

The method comprising the steps of:

A) positioning the sleeve above clamping shoes of a rig, wherein the clamping shoes engage the waist, and the sleeve rests upon the clamping shoes;

B) applying percussion to the threaded joint to loosen the thread connection; and C) unscrewing the joint.

BRIEF DESCRIPTION OF DRAWINGS

The objects and advantages of the invention will become apparent from the following detailed description of a preferred embodiment thereof in connection with the accompanying drawing in which like numerals designate like elements, and in which.

DETAILED DESCRIPTION OF A PREFERRED EMBODIMENT OF THE INVENTION

Figure 5A:
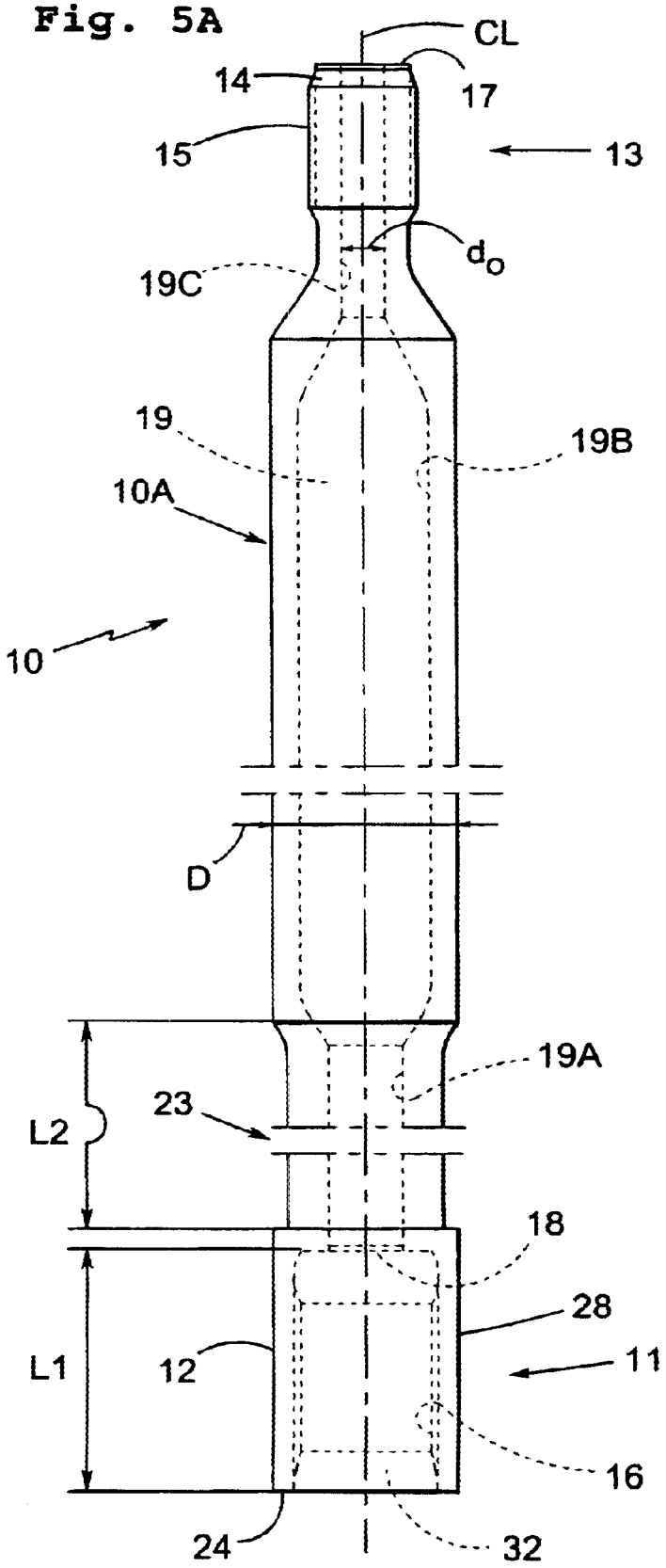
FIG. 5A shows a guide tube according to the present invention in a side view.
Figure 5B:
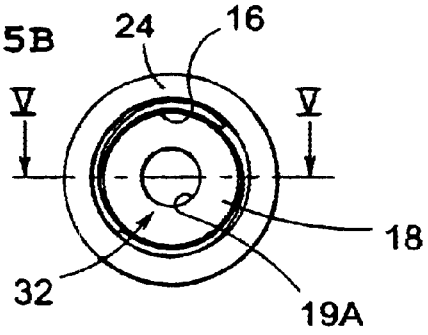
FIG. 5B shows an end view of the guide tube in FIG. 5A.
Figure 5C:
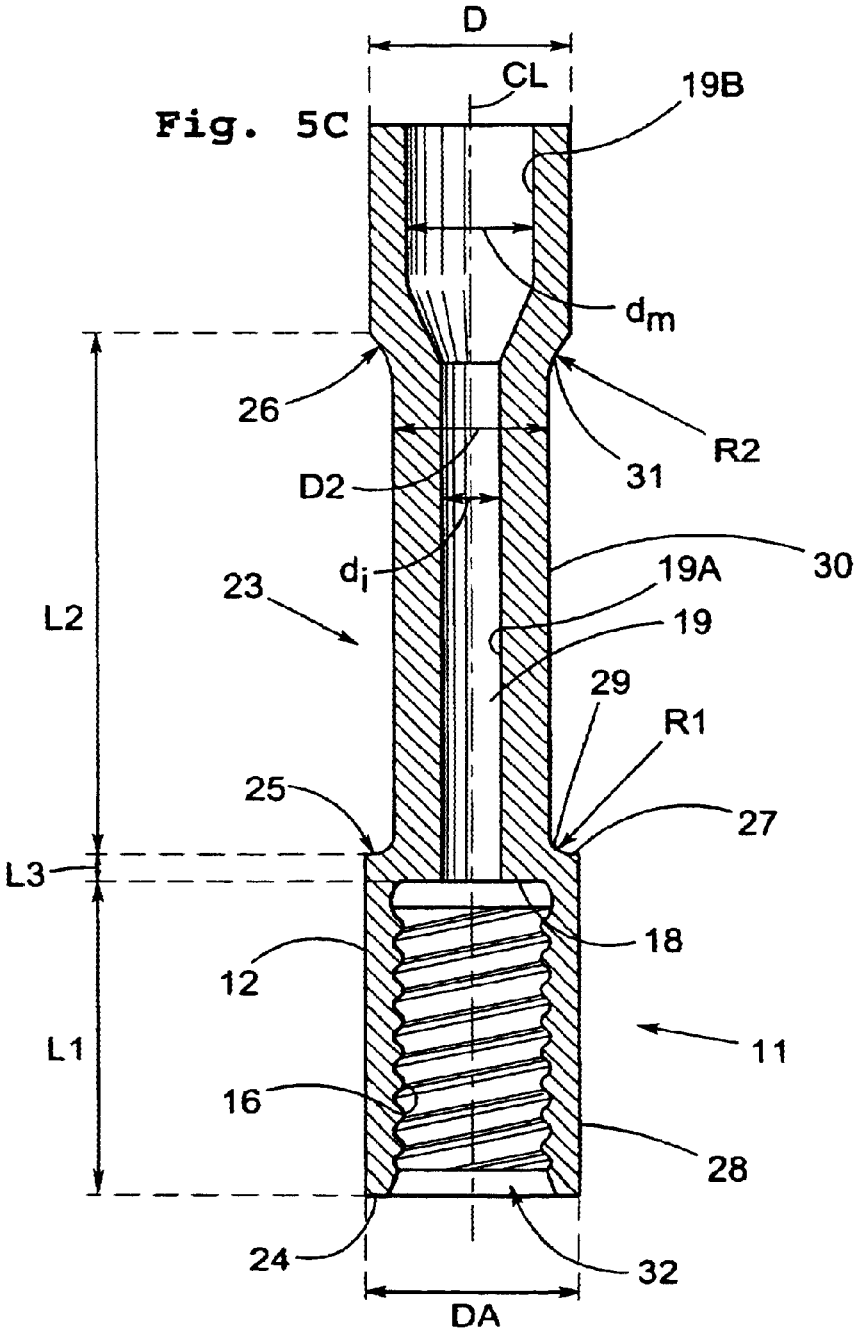
FIG. 5C shows a cross-section according to the line V—V through the guide tube in FIG. 5B.
Figure 6:
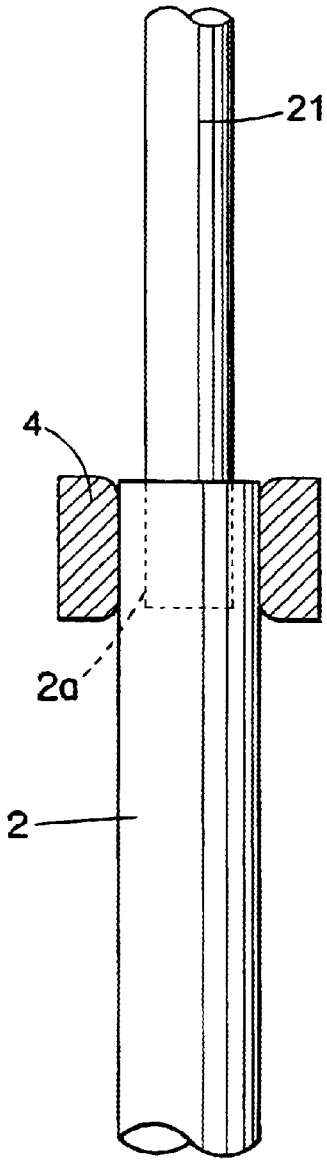
Fig. 6 (PRIOR ART)
FIG. 6 shows the prior art tong during gripping of an end of a prior art guide tube.

An embodiment of a guide tube 10 according to the present invention for mechanical handling in a rig for rock drilling is described hereinafter with reference foremost to FIGS. 5A–5C. The guide tube 10 consists of an elongated main portion or mid portion 10A with a substantially cylindrical basic shape of a diameter D. The guide tube further comprises a first or upper end 11 defined by a welded-on sleeve or female portion 12 and a second or lower end 13 defined by a spigot or male portion 14. The spigot 14 has a substantially cylindrical external thread 15 and the sleeve 12 has a substantially cylindrical internal female thread 16. The female thread 16, or a recess 32 wherein the female thread is provided, has an axial length L1, which substantially extends from an end surface 24 of the sleeve 12 to an abutment surface or bottom 18 in the sleeve.

A flushing channel which is generally depicted 19 extends internally of the guide tube 10, through which a flush medium, usually air or water, is transferred. The through-going flush channel 19 is provided to lead flush medium to a rock drill bit 20 for percussive top hammer drilling (see FIG. 3). This channel is suitably centrally positioned in the cylindrical body and comprises at least three parts 19A, 19B, and 19C. The axial flushing channel part 19A forms an inlet at the first end 11, and the part 19C forms an outlet at the second end 13. The inlet 19A has a diameter $d_i$ that is greater than the outlet diameter $d_o$.

The guide tube 10 comprises a region of reduced outer diameter or a cylindrical waist 23 in connection with, or in the vicinity of, the first end 12. The waist 23 has an axial extension L2 that is longer than said axial length L1. A first shoulder 25 and a second shoulder 26 border the waist at respective axial ends thereof. The first shoulder is provided in the vicinity of the female thread 16 at a distance L3 from the bottom 18. The second shoulder 26 is provided at a distance L2 from the first shoulder 25. The distance L2 is at least 50% longer than the axial depth L1 of the recess 32. For example, in one case L2 is 200 mm and L1 is 120 mm.

The first shoulder 25 comprises a planar portion 27, which is provided perpendicularly to the center axis CL of the guide tube to avoid forcing the shoes 4 apart, see below. The portion 27 connects a 90 degrees to the jacket (outer) surface 28 of the sleeve. The jacket surface 28 defines the outer diameter DA of the sleeve 12. The portion 27 connects radially inwardly via a concave transition 29, having a radius R1, to the substantially cylindrical jacket surface 30 of the waist 23. The second shoulder 26 connects to the jacket surface 30 via a relatively large radius R2, which is greater than the radius R1 of the first shoulder. The diameter D2 of the waist is chosen in the interval 60–80% of the outer diameter D of the guide tube. There can exist a diametrical difference between the diameter D and DA of −10% to +30%, such that the outer diameter D of the mid-portion 10A can be larger or smaller than the outer diameter DA of the sleeve 12, i.e., D is in the range of 0.9DA to 1.3AA.

The flush channel 19 is of restricted diameter in the area 19A of the waist to retain the thickness of the material of the tube, i.e. to maintain tube strength and retain the capacity of the tube to transfer impacts.

The diameter D and the thickness of the tube material are constant at the mid portion 10A of the tube. As noted earlier, the guide tube 10 consists of the mid portion 10A and the two ends 11 and 13 friction-welded thereto. The part 19B of the channel disposed in the mid portion 10A has a diameter $d_m$ which is bigger than, preferably at least twice, the diameter $d_i$ of the inlet 19A. The tube 10 is made of carbon steel but alternatively, the ends 11 and 13 could be made of stainless steel which the mid portion 10*a* made of carbon steel.

Figure 1:
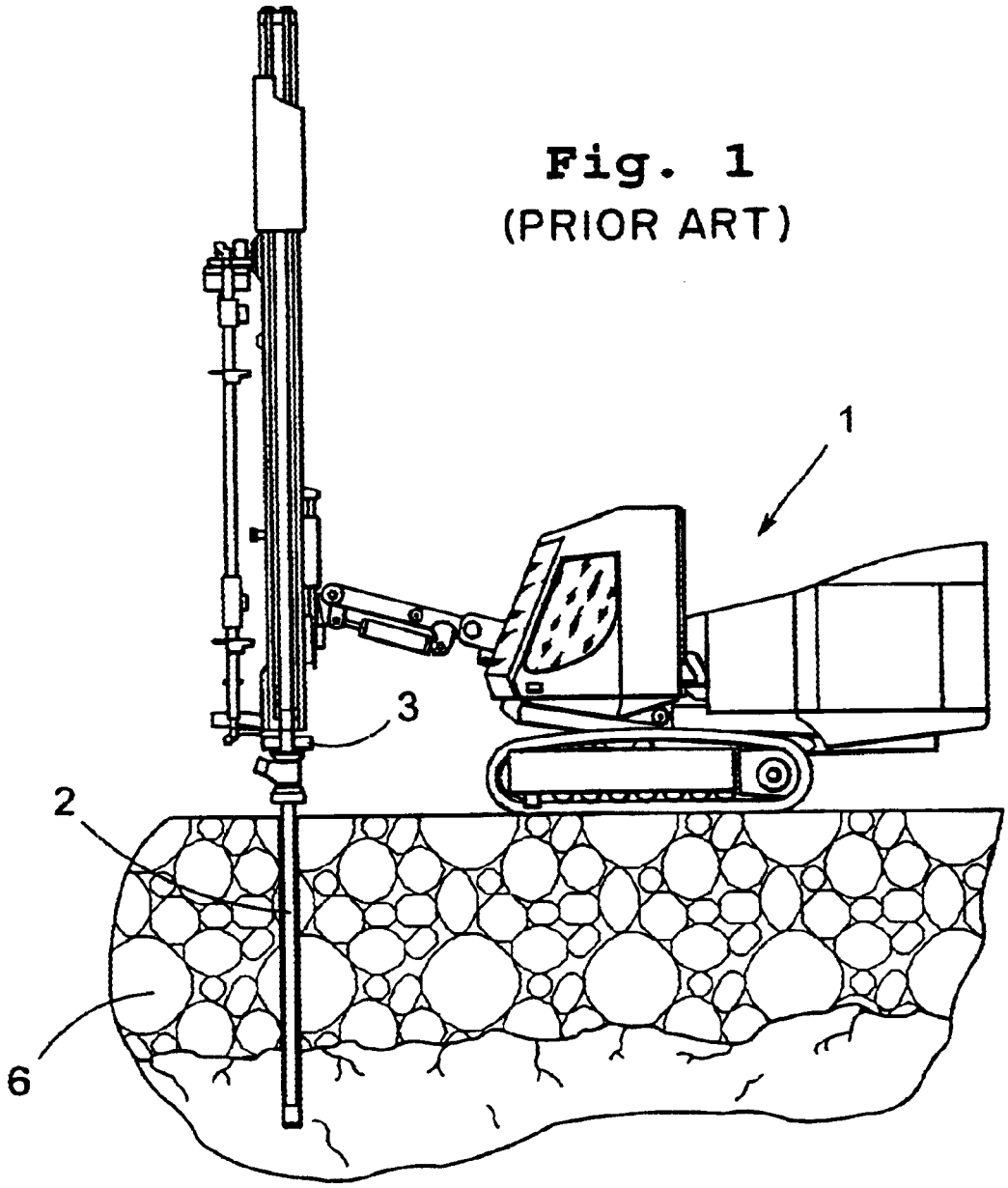
Fig. 1 (PRIOR ART)
FIG. 1 schematically shows a prior art drilling machine for percussive top hammer drilling, in a side view.
Figure 2:
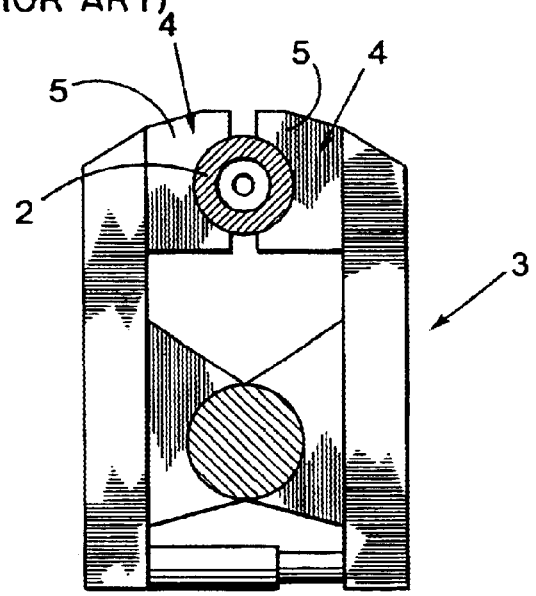
Fig. 2 (PRIOR ART)
FIG. 2 schematically shows a prior tong for unscrewing of thread joints, in a top view.
Figure 3:
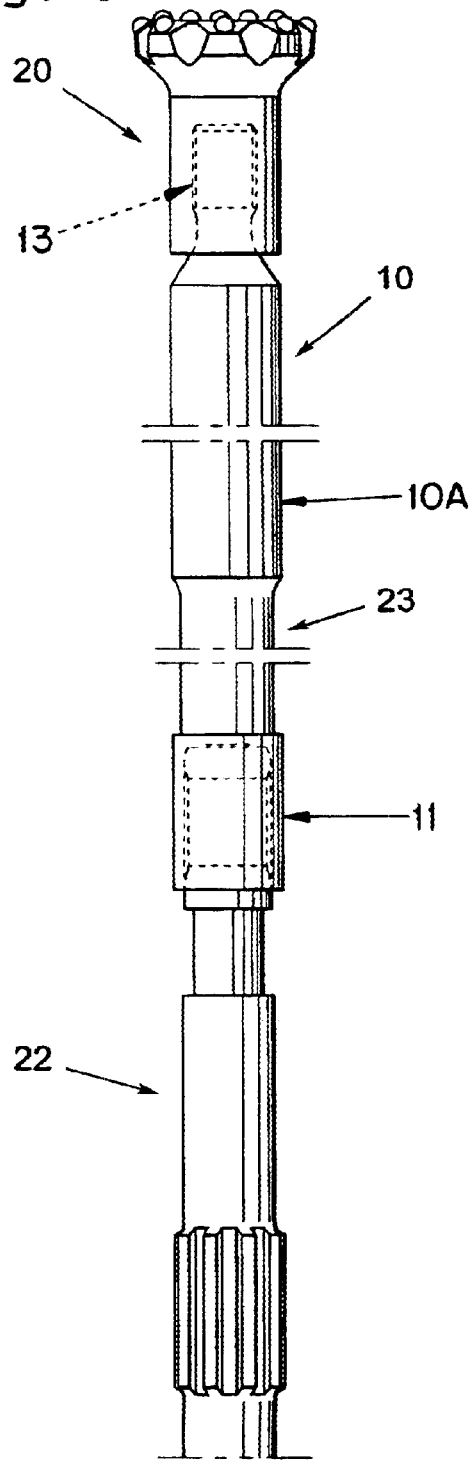
FIG. 3 shows a drill string according to the present invention at an initial stage of the drilling.

In FIG. 3 is shown the appearance of a drill string carrying the guide tube 10 according to the present invention at an initial stage of the drilling operation. The end 11 of the guide tube 10 with the female thread is threaded firmly onto a conventional shank adapter 22, and a conventional rock drill bit 20 having cemented carbide buttons for percussive drilling is threaded firmly onto the other end 13 via the male thread. Thereby, drilling in meters and meters of rock masses can be done with a maintained hole straightness and maintained drill dust discharge since the travel of the drill bit is guided and the flush speed is increased outside and above the drill bit due to the tube 10.

Figure 4:
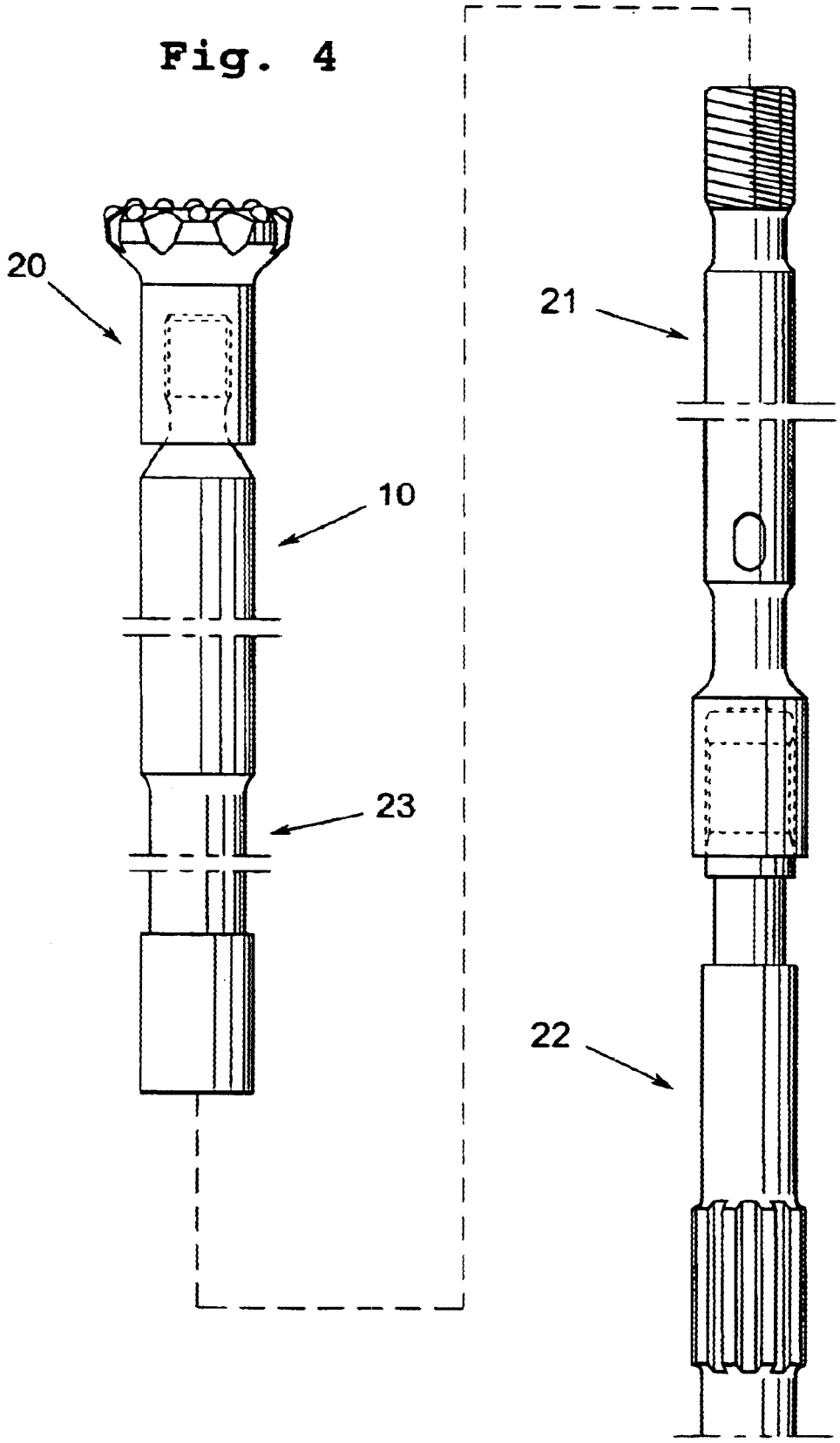
FIG. 4 shows the drill string according to the present invention at a later stage of the drilling.

In FIG. 4 is shown the appearance of the drill string with the guide tube 10 according to the present invention at a later stage of the drilling operation, i.e. when the drill bit 20 has reached a depth of a least about 4 to 6 m. The drill string of FIG. 4 differs from that of FIG. 3 in that an extension rod 21 has been inserted between the guide tube 10 and the shank adapter 22. That is accomplished by first unscrewing the threaded joint between the shank adapter 22 and the guide tube 10. To do so, the shoes 4 of the tongs 3 seize the sleeve 12, while the components 10, 22 are rotated relative to each other (see FIG. 7B). The extension rod 21 is then threaded into the guide tube 10, and the shank adapter 22 is then threaded into the extension rod.

Figure 7A:
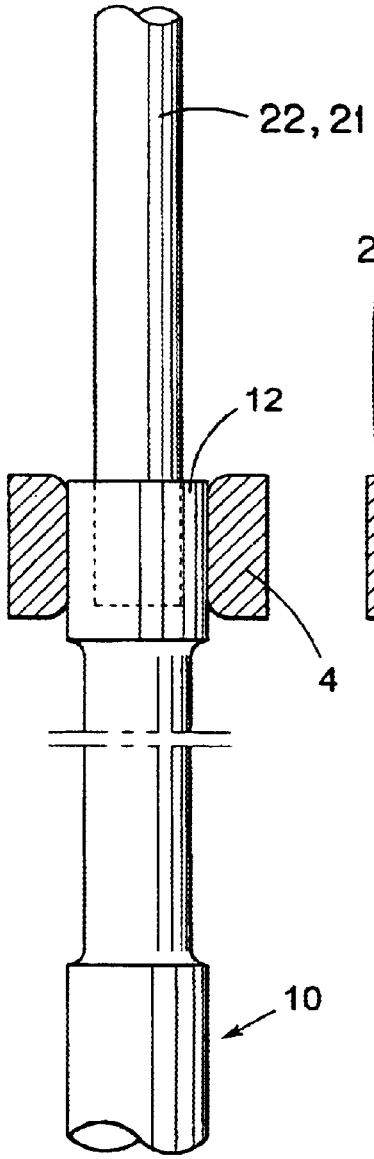
FIG. 7A shows the prior art tong seizing the end of a guide tube according to the present invention.
Figure 7B:
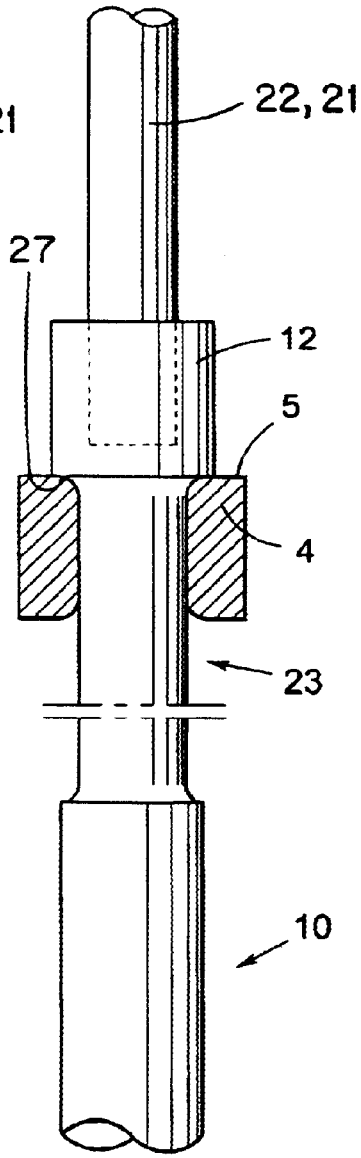
FIG. 7B shows the prior art tong gripping a guide tube according to the present invention in position for unscrewing.

The usual position of the shoes 4 during unscrewing or tightening of the extension rod 21 relative to the guide tube is shown in FIG. 7A, i.e. the shoes 4 clamps the outer circumference of the sleeve 12. However, if the threaded joint is stuck and resists unscrewing, the position according to FIG. 7B is used, i.e. the shoes 4 clamp around the waist 23 while the shoulder 27 rests against upper sides 5 of the shoes. In this position the threaded joint can be impacted loose without overheating the threads or deforming the sleeve 12 since the support from the upper sides 5 is stable. The diameter D2 of the waist 23 is chosen to be substantially as large as the diameter of extension rod 21. The length L2 of the waist is chosen to be at least large enough to allow positioning of the shoes 4 around the waist without any problems.

It will be appreciated that the guide tube 10 can be positioned as shown in FIG. 7B when unscrewing either the shank adapter 22 or the extension rod 21 therefrom.

Thus the present invention relates to a guide tube and a drill string for mechanical handling in a rig for rock drilling which simplifies unscrewing of thread joints at percussive rock drilling equipment and which improves the life-span for these thread joints.

Although the present invention has been described in connection with a preferred embodiment thereof, it will be appreciated by those skilled in the art that additions, modifications, substitutions and deletions not specifically described, may be made without departing from the spirit and scope of the invention as defined in the appended claims.

What is claimed is:

1. A guide tube adapted for use in a percussive rock drill string, the guide tube comprising:

a main portion;

a sleeve disposed at a first end of the main portion, the sleeve including a recess having a female screw thread formed therein; and a male thread portion disposed at a second end of the main portion, a flush channel extending completely through the main portion and the male thread portion and communicating with the recess, the recess having a first length extending along a longitudinal axis of the guide tube;

the main portion including a section of reduced cross-section disposed adjacent the first end for defining a waist of narrower cross section than a maximum cross section of the sleeve, the waist having a second length extending along the axis which is longer than the length of the recess and shorter than a third length of the rest of the main portion, wherein a wall thickness of the waist is no less than a maximum wall thickness of the sleeve.

2. The guide tube according to claim 1 wherein the waist is bordered at its axial ends by first and second shoulders, the first shoulder disposed between the waist and the sleeve.

3. The guide tube according to claim 2 wherein the second length being at least 50% greater than the first length.

4. The guide tube according to claim 2 wherein at least a radially outer portion of the first shoulder extends substantially perpendicularly to the axis of the guide tube.

5. The guide tube according to claim 2 wherein the second shoulder is of concave shape defined by a radius.

6. The guide tube according to claim 5 wherein a radially inner portion of the first shoulder is of concave shape defined by a radius smaller than a radius of the second shoulder.

7. The guide tube according to claim 1 wherein an outer periphery of the waist is cylindrical and has a first diameter; a remainder of the main portion has a second diameter; the first diameter being in the range of 60–80% of the second diameter.

8. The guide tube according to claim 1 wherein the outer periphery of the sleeve is of cylindrical shape; the main portion having, except along the waist, an outer diameter in the range of 0.9 to 1.3 times the diameter of the sleeve.

9. The guide tube according to claim 1 wherein the flush channel has a cross section within the waist which is smaller than a cross section of the flush channel in a remainder of the main portion.

10. The guide tube according to claim 1 wherein the flush channel includes a first portion disposed within the waist, a second portion disposed in a remainder of the main portion, and a third portion disposed within the male thread portion; a diameter of the first portion being larger than a diameter of the third portion.

11. A drill string for percussive rock drilling; comprising a drill bit, a guide tube connected to the drill bit, an extension rod connected to the guide tube, and a shank adapter connected to the extension rod; the guide rod comprising:

a main portion;

a sleeve disposed at a first end of the main portion, the sleeve forming a recess having a female screw thread formed therein; and a male thread portion disposed at a second end of the main portion and threadedly attached to the drill bit, a flush channel extending completely through the main portion and the male thread portion and communicating with the recess, the recess having a first length extending along a longitudinal axis of the guide tube;

the main portion including a section of reduced cross-section disposed adjacent the first end for defining a waist of narrower cross section than a maximum cross section of the sleeve, the waist having a second length extending along the axis and being longer than the length of the recess and shorter than a third length of the rest of the main portion, wherein a wall thickness of the waist is no less than a maximum wall thickness of the sleeve.

12. A method of unscrewing a threaded joint between a member and a guide tube of a drill string, the guide tube comprising:

a main portion;

a sleeve disposed at a first end of the main portion, the sleeve forming a recess having a female screw thread formed therein; and a male thread portion disposed at a second end of the main portion, a flush channel extending completely through the main portion and the male thread portion and communicating with the recess, the recess having a first length extending along a longitudinal axis of the guide tube;

the main portion including a section of reduced cross-section disposed adjacent the first end for defining a waist of narrower cross section than a maximum cross section of the sleeve, the waist having a length extending along the axis and is longer than the length of the recess;

the method comprising the steps of:

A) positioning the sleeve above clamping shoes of a rig, wherein the clamping shoes engage the waist, and the sleeve rests upon the clamping shoes;

B) applying percussion to the threaded joint to loosen the thread connection; and C) unscrewing the joint.

* * * * *